United States Patent [19]

Spiteri

[11] 3,935,505

[45] Jan. 27, 1976

[54] FLUORESCENT LAMP DIMMER

[76] Inventor: Joseph Spiteri, 6613 E. Lake Road, Erie, Pa. 16511

[22] Filed: Jan. 21, 1974

[21] Appl. No.: 434,985

[52] U.S. Cl. ..... 315/194; 315/158; 315/291; 315/DIG. 4; 338/120

[51] Int. Cl.[2] ..... H05B 41/392; G05F 1/08

[58] Field of Search..... 315/DIG. 4, DIG. 5, DIG. 7, 315/194, 199, 149, 156, 158, 200, 208, 291, 307, 311, 151; 323/22 Z; 338/120, 128, 320

[56] References Cited

UNITED STATES PATENTS

| | | | |
|---|---|---|---|
| 2,345,638 | 4/1944 | Sperti | 315/99 |
| 2,785,260 | 3/1957 | Matthew | 338/120 |
| 3,061,744 | 10/1962 | Spira | 307/146 |
| 3,103,618 | 9/1963 | Slater | 323/22 |
| 3,180,999 | 4/1965 | Kuykendall | 315/DIG. 4 |
| 3,344,311 | 9/1967 | Nuckolls | 315/199 |
| 3,361,931 | 1/1968 | Vollrath | 315/199 X |
| 3,422,309 | 1/1969 | Spira et al. | 315/199 X |
| 3,449,629 | 6/1969 | Wigert et al. | 315/151 |
| 3,496,451 | 2/1970 | Duncan | 315/DIG. 4 |

*Primary Examiner*—Archie R. Borchelt
*Assistant Examiner*—E. R. LaRoche
*Attorney, Agent, or Firm*—Ralph Hammar

[57] ABSTRACT

A solid state dimmer for fluorescent lights with standard (non-dimming) ballasts. Dimming is adjusted by changing the resistance in a capacitor charging circuit. Features include a trimming adjustment for eliminating flicker, a voltage regulator compensating for line voltage change, a sequential switch which allows the lamp to heat up before being dimmed, and a diode varistor, zener thyrector or the like in the charging circuit which supply additional charging current as the dimming is increased. The dimmer mounts in the same outlet box as a conventional toggle switch and can be substituted for the switch in an existing installation without changing the ballast. The dimmer is also useful for other loads requiring a variable voltage.

4 Claims, 12 Drawing Figures

FLUORESCENT LAMP DIMMER

Prior to this invention, fluorescent lamps with standard ballasts could not be substantially dimmed. The commercially available dimmers for incandescent lamps carry a warning against use with fluorescent light fixtures. For dimming fluorescent lamps, special dimming ballasts were required, which cost many times as much as standard ballasts and require a comparably expensive control. When installing a dimming control in an existing installation of fluorescent lights, it was necessary to change all of the ballasts.

An object of this invention is to formulate a circuit for dimming fluorescent lamps with standard ballasts.

The invention uses a circuit that could be put in an I. C. Chip (employing a bidirectional triode thyristor) and a switch control.

Another object of my invention is to provide a fluorescent dimmer with no special dimming ballast. The conventional or standard ballast is all that is required.

A further object of the invention is to provide a dimmer which causes no loss of light when used with a conventional/standaard ballast.

Still a further object of my invention is to provide a totally integrated component dimmer.

A further object of this invention is to provide a fluorescent dimmer that will work on mercury vapor lamps.

Still another object is when said mercury vapor lamp-/lamps are used at maximum light position, there is no measurable loss of light or power.

Another object of my invention is to add to the like circuits, a cadmium sulfide photocell or like across the condenser charging potentiometer. This will adjust or regulate its circuit parameter to keep the light source uniform when the light level of the room changes, i.e., brightens or darkens.

It is a further object of my present invention to provide a circuit of the illustrated types which will regulate or adjust itself when line voltage increases or decreases.

It has been written what is considered a preferred embodiment of the invention but it is obvious that numerous changes and omissions may be made without departing from its spirit.

This invention may be further understood from the following description and drawings in which FIG. 1 is a bottom perspective of a fluorescent dimmer control, FIG. 2 is a similar view of the control with a voltage regulator, FIG. 3 is a perspective of the mounting strap or heat sink which mounts the control in a standard electric switch box, FIG. 4 is an elevation of the switch used in the FIGS. 1 and 2 controls, FIG. 4*a* is a front view of the control mounted in an outlet box, FIGS. 5, 6, and 7 are circuit diagrams for the FIG. 2 control, FIG. 8 is a perspective of a variable voltage extension cord, FIG. 9 is a circuit diagram for FIG. 8,

FIG. 10 is a dimmer circuit using zeners or the like, and

Figure 1:
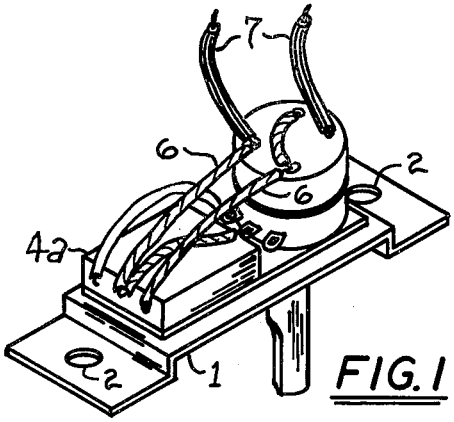
Figure 2:
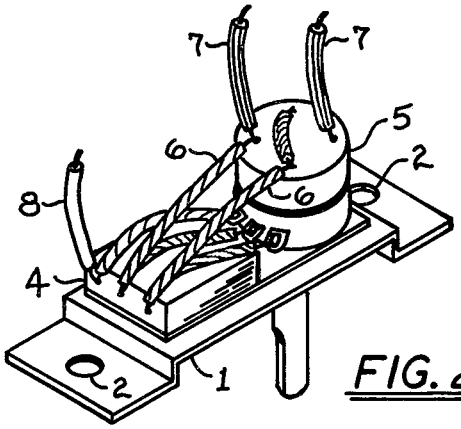
Figure 3:
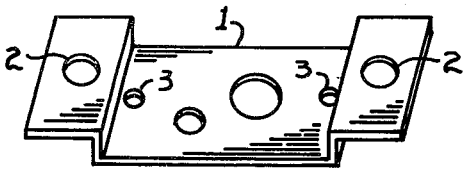
Figure 4:
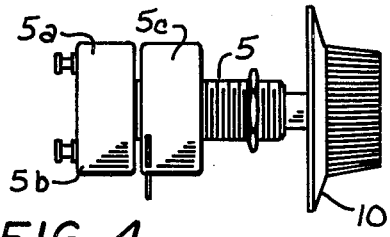
Figure 4A:
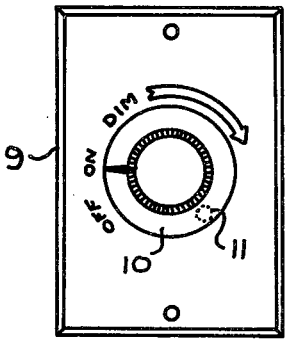

The control unit is mounted on a mounting strap or heat sink 1 having the same mounting dimensions as a toggle switch. The strap is fastened to an outlet box by screws through holes 2 and the wall plate is fastened to the strap by screws through holes 3. All of the circuit components of the control are mounted on the underside of the strap. The circuit components are contained in a chip 4 or 4a connected to a switch unit 5 by wires 6. The power connections to the control are made through black wires 7. The control unit of FIG. 2 which includes a voltage regulator has a white wire 8 which connects the voltage regulator across the power supply. When installing the control in an existing installation, the control units are substituted for the conventional wall switch. The wall switch is removed from its box, the black wires which have previously been connected to the switch are connected to the black wires 7 of the control, the white wire of the power supply is connected to the white wire 8 of the control, and the control is mounted in the switch box by screws through holes 2. When completely installed, a wall plate 9 is mounted on the strap. The switch knob 5 is turned to the "on" position and the lamps operated for 1 or 2 minutes to allow the lamps to heat up. The knob is then rotated clockwise to the maximum dim position and the knob removed to expose a trimmer screw 11 which is adjusted until the lights remain on without flickering. The trimmer screw 11 adjusts the control to the peculiarities of the fluorescent lighting system such as the number, type and age of the lamps, the type of ballast, the line voltage, etc. After this adjustment, the lights will operate without flicker after the lights have been on for the warm-up period of 1 or 2 minutes.

Figure 5:
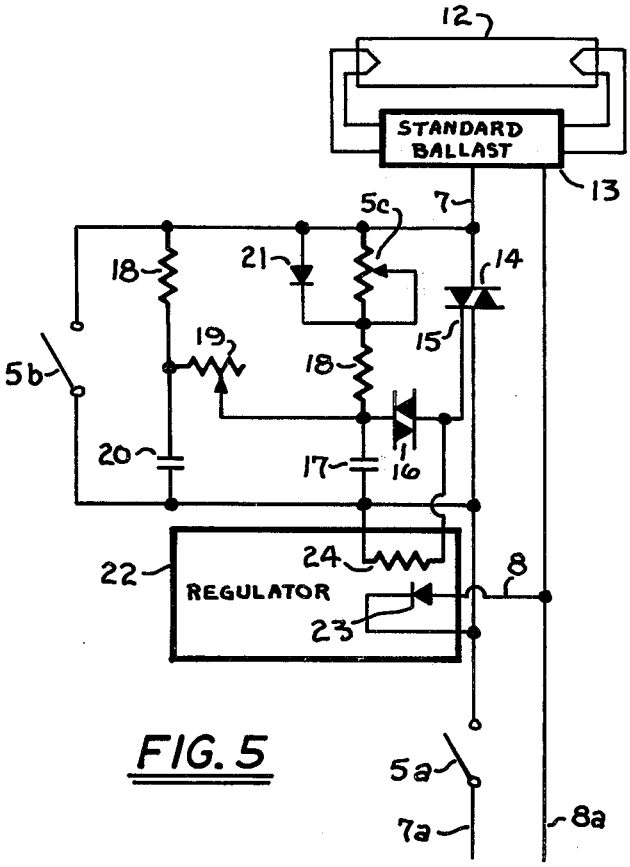

In the circuit diagram of FIG. 5, the black and white lines of a conventional household alternating current power supply, e.g. 110 volts 60 cycle A. C., are designated by the numerals *7a* and *8a*. The power supply is connected through the control unit to a fluorescent lighting system having one or more fluorescent lamps 12 and one or more standard ballasts 13. The system may include different types of lamps and ballasts. The system may also include other types of lamps such as mercury vapor and incandescent lamps. The switch 5 for the control includes an on/off switch *5a*, a dimmer switch *5b*, and a dimmer potentiometer *5c*, all operated separately (not shown) or by the same knob 10. Such switches may be assembled from commercially available designs operable by push/pull or rotation of the knob. When the knob is turned or moved to the on position, the line switch *5a* is closed, the dimmer switch *5b* is closed to short-circuit or bypass the dimmer control and the potentiometer *5c* is in its minimum or zero dim position. The lighting system now operates at full brightness just as though the dimmer control were not there. This provides 100% lighting with no loss of lighting efficiency which has heretofore resulted from dimmer controls. When the knob 10 is rotated past the on position to the "dim" position, the potentiometer *5c* is actuated or adjusted to control the dimming by controlling the flow of current through a "triac" switch 14 having a gate electrode 15.

Every time a pulse is applied to the gate 15 of the triac switch 14, the triac switch closes and the remaining portion of that half cycle of A. C. flows through the lamps.

During "zero" point of the cycle, the triac switch is open. The next gate pulse closes the triac switch for the remaining portion of the half cycle and the process is repeated.

A double diode, "Diac" 16, conducts in both directions sharply as the voltage exceeds the break-over value. The diac gates the triac switch with a sharp pulse that closes the triac switch.

Potentiometer control 5*c* limits the voltage to which capacitor 17 is charged to the Diac 16 break-over voltage. At break-over voltage value, capacitor 17 supplies a sudden surge of current which switches the triac 14 on. At lower brightness level, control 5*c* increases the charging circuit resistance. This decreases the charging rate and delays the break-over voltage point.

The capacitor 17 is charged through the potentiometer 5*c* and resistance 18. When the potentiometer 5*c* is set for maximum dimness, the value of charging resistance is greatest and the time required to charge capacitor 17 to the break-over point is longer resulting in a smaller portion of the A. C. voltage being applied to the lamps. The capacitor 17 is also charged through a resistor 18 and through a trimming resistor 19. The position of variable resistor 19 is set by the trimmer screw 11 which insures that at maximum dimness the lamps do not flicker. The resistor 18 also charges a capacitor 20 which assists the capacitor 17 in triggering the triac. Capacitors 17 and 20 are also charged through a diode 21 which in this circuit is used as a voltage responsive resistor (varistor). Other voltage responsive elements can be substituted for the diode 21 such as zeners or the like. When the control 5*c* is adjusted so that its resistance is small, no current flows through the diode 21. When the control is adjusted so that its resistance is large, current flows through the diode to provide an additional reservoir of charge for the capacitors 17 and 20. The rectifying properties of the diode are not fully used. The polarity of the diode may be reversed and the operation will not be changed. The capacitors 17, 20 are large (one to several microfarads) and when discharging through the diac 16 provide sharp pulses which produce a peaked wave form which keeps the lamps lighted at low brightness levels such as 25–50%. The sharp pulses maintain the peak voltage which is important in preventing flicker at low brightness. As the brightness goes from 100 to 25%, the peak voltage goes from 100 to about 90%.

A regulator 22 having a light source 23 connected across the power supply and the photocell 24 actuated by the light source is used to compensate for fluctuations in line voltage. As the line voltage rises, the intensity of light from the source 23 increases and the resistance of the photocell 24 decreases. This effectively lowers the voltage at gate 15 below the value which would be obtained at normal voltage and causes later firing of the triac 14. However, since the line voltage is greater, the later firing of the triac still maintains the same brightness level. The reverse effect takes place when the line voltage lowers. The effect of the regulator is to smooth out the changes in brightness and prevent flicker and starting cycle which would normally take place with a drop in line voltage. In the particular regulator illustrated, the light source is a light emitting diode and the photocell is cadmium sulfide chip or the like.

Figure 6:
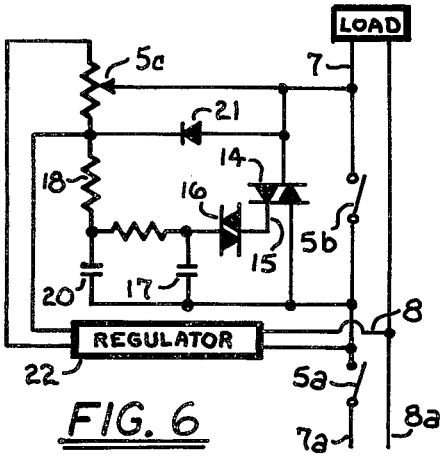

In the circuit of FIG. 6 where corresponding parts are indicated by the same reference numerals, the voltage regulator 22 is connected across the dimness potentiometer 5*c* where its effect is primarily to lengthen the charging time of capacitors 17, 20 as the line voltage increases and to shorten the charging time of the capacitors as the line voltage decreases so as to eliminate fluctuations in brightness due to fluctuations in line voltage.

Figure 7:
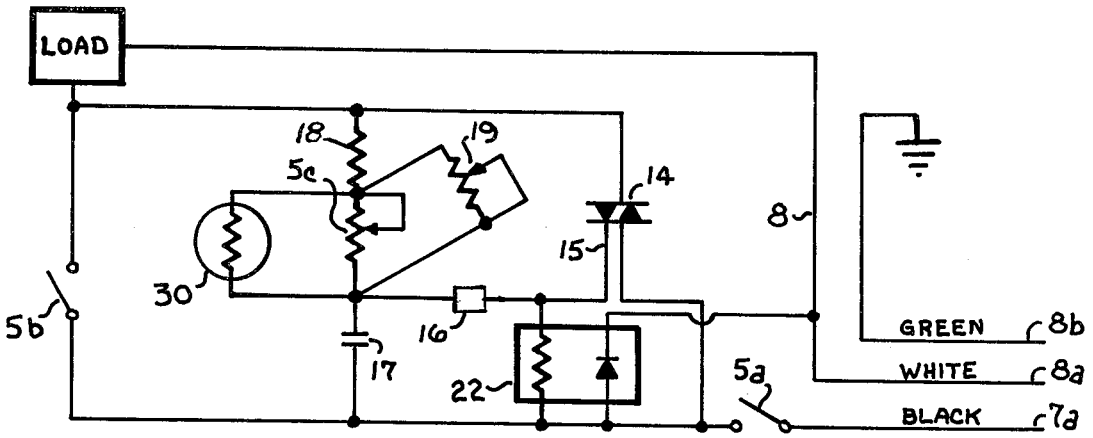

In the circuit of FIG. 7 where corresponding parts are indicated by the same reference numerals, an improved bidirectional asymmetrical switch has been substituted for the diac 16. A photocell 30 such as a cadmium sulfide cell or the like which responds to room light level has been added. As the light level increases, the resistance of the cell decreases and vice versa. Since the cell 30 is connected across the dimming potentiometer 5*c*, the effective charging resistance for capacitor 17 is modified in the direction to compensate for changes in the light level. The photocell is an optional feature.

Figure 8:
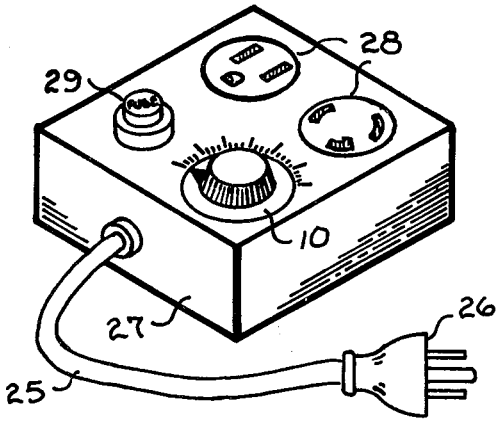
Figure 9:
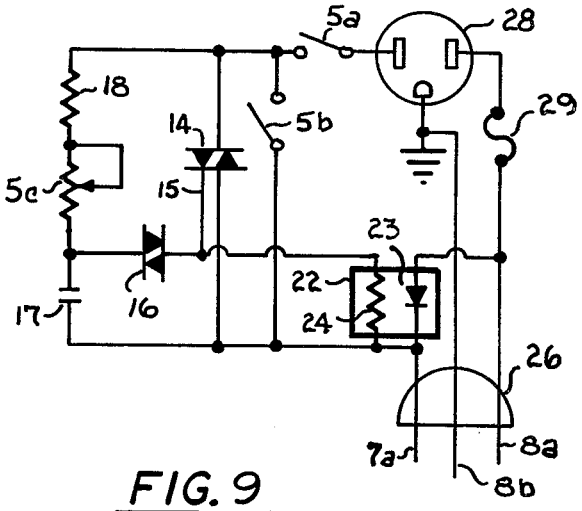

In FIGS. 8 and 9, the dimmer control circuit is simplified and is modified for use in an extension power cord. Corresponding parts are indicated by the same reference numerals. The extension cord 25 is of the three-wire grounded type where in addition to the conventional black and white wires 7a, 8a, there is a third green or ground wire 8b. At one end of the cord is a plug 26 and at the other end of the cord is a box 27 having receptacles 28, a fuse 29, and a knob 10 for controlling the voltage output of the circuit enclosed within the box. The circuit within the box shown in FIG. 8 is similar to the previously described circuits and common parts are indicated by the same reference numerals. Instead of the output of the circuit being connected to a fluorescent lamp, the output is connected to the receptacles 28. In the full voltage position of the control knob 10, the switches 5*a* and 5*b* are closed. In the adjustable voltage positions of the knob, the switch 5*b* is open and the potentiometer or switch 5*c* changes the charging resistance for capacitor 17 to adjust the voltage.

Figure 10:
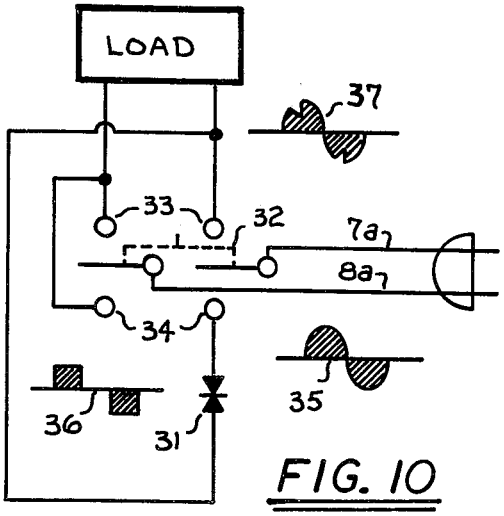
Figure 11:
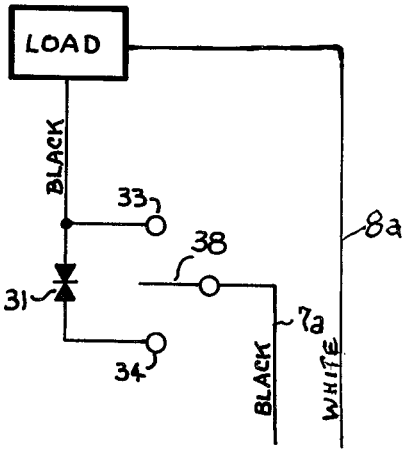
FIG. 11 is another circuit similar to FIG. 10.

In the circuits of FIGS. 10 and 11, back-to-back zener diodes or equivalent semiconductor devices 31 are used to produce as much as, and, in some cases more than, a 25–30% reduction in brightness without causing the fluorescent lights to flicker or go into the starting cycle which could cause burn-out of the starters and ballasts. In FIG. 10, the incoming power lines 7*a*, 8*a* are connected to a double throw switch 32 having an "off" position (shown), a full on position in which the switch closes against contacts 33 and a dim position in which the switch closes against the contacts 34. In the dim position, the voltage in the incoming power which has a sine wave form shown at 35 is converted to a square wave shown at 36. This square wave form when applied to the fluorescent lights results in a peak wave form shown at 37, which permits a 25–30% reduction in light without causing the fluorescent lights to flicker or to go into the starting cycle. The wave form 37 has approximately 14% lower RMS voltage than the incoming voltage across lines 7*a*, 8*a*. Mere reduction of the incoming voltage by 14% without the change in wave form caused by the zener diodes 31 or the like would cause the fluorescent lights to flicker and would cause the fluorescent lights to go into the starting cycle with the resulting over-heating and burn-out of the starters and ballasts. In the circuit of FIG. 11, there is a single pole switch 38 inserted in the black wire of a conventional power supply. The operation is the same as FIG. 10.

Circuit elements and components may be interchanged and equivalents substituted. For example, the switches shown in FIGS. 1 through 11 are interchangeable, a unijunction such as GE2N2646 oscillator can be used as a trigger circuit for the triac to further improve symmetry and feedback, and the asymmetrical switch can be replaced by a diac if symmetry of wave form is required.

What I claim is:

1. A brightness control for a fluorescent lamp connected to a power supply, comprising: switch means connected between the power supply and the lamp, dimming control means connected between the switch means and the lamp, said dimming control means comprising electrode controlled semi-conductor switch means for blocking the flow of power to the lamp during each half cycle until gated on, capacitor means charged during each half cycle, gating means actuated in response to the charge on said capacitor means for gating said semi-conductor switch means to conduct, means for adjusting the charging rate of the capacitor means to advance or retard the gating of said semi-conductor switch means and thereby decrease or increase the dimming, said dimming control means being adjustable in a range from minimum dim to maximum dim, said switch means for connecting said dimming control and said lamp in a plurality of circuit relationships, to-wit: an off position, an on position connecting the power supply to the lamp and bypassing the dimming control means, a minimum dim position opening the bypass around the dimming control and positions between said minimum dim position and a maximum dim position, control means for actuating said switch means in order listed so the lamp has a chance to warm up before being dimmed, a mounting strap to be fastened to an outlet box, means for mounting the dimming control means on the mounting strap, a wall plate mounted on the strap, a switch control extending through the plate, and trimming means having adjusting means accessible through and from the outside of the plate for adjusting the dimming effect in the maximum dim position so the lamp remains on without flickering in said maximum dim position.

2. A brightness control for a fluorescent lamp connected to a power supply, comprising: switch means connected between the power supply and the lamp, dimming control means connected between the switch means and the lamp, said dimming control means being adjustable in a range from minimum dim to maximum dim, said switch having means for connecting said dimming control and said lamp in a plurality of circuit relationships, to wit: an off position, an on position connecting the power supply to the lamp and bypassing the dimming control means, a minimum dim position opening the bypass around the dimming control and positions between said minimum dim position, and control means for actuating said switch means in order listed so the lamp has a chance to warm up before being dimmed, a mounting strap to be fastened to an outlet box, means for mounting the dimming control means on the mounting strap, a wall plate mounted on the strap, a switch control extending through the plate, and trimming means having adjusting means accessible through the plate for adjusting the dimming effect in the maximum dim position so the lamp remains on without flickering in said dim position, a knob for the switch control on the outside of the wall plate and adjusting means for the trimming means being covered by the knob and accessible when the knob is removed.

3. A brightness control for a fluorescent lamp or the like connected to a power supply, comprising: switch means connected between the power supply and the lamp, dimming control means connected between the switch means and the lamp, said dimming control means comprising gate electrode controlled semi-conductor switch means for blocking the flow of power to the lamp during each half cycle until gated on, capacitor means charged during each half cycle, gating means actuated in response to the charge on said capacitor means for gating said semi-conductor switch means to conduct, means for adjusting the charging rate of the capacitor means to advance or retard the gating of said semi-conductor switch means and thereby decrease or increase the dimming, said dimming control means being adjustable in a range from minimum dim to maximum dim, said switch means having means for connecting said dimming control and said lamp in a plurality of circuit relationships, to-wit: on, off and dim, a mounting strap to be fastened to an outlet box, means for mounting the dimming control means on the mounting strap, a wall plate mounted on the strap, a switch control extending through the plate, and trimming means having adjusting means accessible through and from the outside of the plate for adjusting the dimming effect in the maximum dim position so the lamp remains without flickering in said maximum dim position.

4. A brightness control for a fluorescent lamp or the like connected to a power supply, comprising: switch means connected between the power supply and the lamp, dimming control means connected between the switch means and the lamp, said dimming control means being adjustable in a range from minimum dim to maximum dim, said switch means having means for connecting said dimming control and said lamp in a plurality of circuit relationships, to wit: on, off and dim, a mounting strap to be fastened to an outlet box, means for mounting the dimming control means on the mounting strap, a wall plate mounted on the strap, a switch control extending through the plate, and trimming means having adjusting means accessible through the plate for adjusting the dimming effect in the maximum dim position so the lamp remains on without flickering in said maximum dim position, a knob for the switch control on the outside of the wall plate and the adjusting means for the trimming means being covered by the knob and accessible when the knob is removed.

* * * * *